United States Patent [19]

Sawyer

[11] Patent Number: 5,077,090

[45] Date of Patent: Dec. 31, 1991

[54] METHOD OF FORMING DUAL ALLOY DISKS

[75] Inventor: Thomas F. Sawyer, Charlton, N.Y.

[73] Assignee: General Electric Company, Schenectady, N.Y.

[21] Appl. No.: 487,094

[22] Filed: Mar. 2, 1990

[51] Int. Cl.[5] ..... B05D 3/12

[52] U.S. Cl. ..... 427/241; 427/404; 427/405; 427/422; 427/425; 427/427

[58] Field of Search ..... 427/241, 404, 405, 422, 427/427, 425

[56] References Cited

U.S. PATENT DOCUMENTS 4,066,117 1/1978 Clark et al. ..... 427/425

4,464,414 8/1984 Milewski et al. ..... 427/425

*Primary Examiner*—Janyce Bell

*Attorney, Agent, or Firm*—Paul E. Rochford; James C. Davis, Jr.; James Magee, Jr.

[57] ABSTRACT

A method for forming a preform having an inner portion of a first metal and an outer portion of a second metal is taught. The preform is fabricated by spray forming processing. The beginning stages of the spray forming is performed with a first metal in a dispensing crucible which supplies a stream of the first metal to an atomization zone where the stream is broken up into many droplets which are driven by an atomizing gas onto a receiving surface. The second stage of the processing involves adding small quantities of a second metal to the dispensing crucible before the first metal is completely drained therefrom to permit a blend of the two metals to be formed on the preform between an inner and an outer portion thereof. The third phase of the method is the addition of a second metal to the dispensing crucible so that the latter stages of the spray forming is performed with the second metal and accordingly that the outer portions of the preform are formed of the second metal. A desirable good metallurgical bond is formed between the inner and the outer portions of the preform.

4 Claims, 2 Drawing Sheets

METHOD OF FORMING DUAL ALLOY DISKS

CROSS REFERENCE TO RELATED APPLICATIONS

The subject application is closely related to copending applications Ser. Nos. 07/487,095 now U.S. Pat. No. 4,870,045 and 07/487,511, filed Mar. 2, 1990; and Ser. No. 07/489,300, filed Mar. 5, 1990 incorporated herein by reference.

BACKGROUND OF THE INVENTION

The present invention relates to the formation of structures of more than one alloy composition. More particularly, it relates to a method by which disks can be formed having an inner core alloy of one composition and a rim alloy of a different composition.

It is known that superalloys including nickel base and iron base superalloys have been employed extensively in applications which require high strength at high temperature. The design of jet engines has in large part been determined by the properties which superalloys used as fabricating materials for components of the engine can display. As the properties of the alloys are improved the design of the jet engine improves and greater thrust to weight ratios are achieved. Generally, higher temperature operation results in greater fuel efficiency for such engines and the drive for higher operating temperatures and for superalloy materials which can operate at such higher temperatures is a continuous design criteria for fabrication of more and more efficient jet engines. The need for higher temperature capability in high strength superalloys continues as efforts are made to continue to improve operating performance for jet engines.

Many metallurgical advances have assisted in improving high strength superalloys. These have included the increase in the precipitate volume fraction for the gamma prime precipitate strengthening agent of such alloys. Also improvements have been made through powder metallurgy and through the use of isothermal forging. Improvements in the alloy temperature capability of superalloys have been achieved in this way. It has also been recognized that not all components of a jet engine are subject to the same operating conditions and that different metallurgical compositions may be employed in different components of the engine to best suit the needs of that component.

There are some parts where tradeoffs have been made in properties because the part is large enough so that the engine operating conditions over the full extent of the part are not uniform. In other words, certain large pieces which are installed in an engine encounter different temperatures and different property requirements and service from one portion of the component to another. Accordingly, for such large components it is necessary to sacrifice a property in one location of the component in order to obtain a acceptable property at another location. Such different properties are needed for example in engine disks which rotate at high speeds of 12,000 revolutions per minute and more and result in the application of high stress to portions of the disk and particularly to the outer portions of the disk.

In order to compensate for the different property requirements of the different portions of the disk, schemes and methods have been devised to impart desirable combinations of properties to the inner and outer portions of such disks. For example, the U.S. Pat. No. 4,820,358 issued to the assignee of the subject application has taught a method by which a disk made of a single alloy can be given different properties at its inner or core portion as contrasted with its outer or rim portion. The attainment of different properties in the different portions of the disk is a valuable achievement.

Other efforts have been made to form an inner portion of a disk of one alloy and an outer portion of a different alloy. However, problems have arisen where efforts are made to join the two alloys together. If oxide layers exist at the boundary it is difficult to be sure that any welding that has occurred overcomes the presence of the oxide and does not leave a region of weakness in the disk. The detection of flaws in such weldments between an inner and outer portion of a disk is difficult.

The present method is directed toward overcoming the difficulty of having an oxide layer which can cause points of weakness or imperfect welds between the inner and outer portions of alloy disks where such inner and outer portions are of different alloy materials.

BRIEF STATEMENT OF THE INVENTION

It is accordingly one object of the present invention to provide a method for forming a composite disk having two or more different alloys at the inner and outer portions thereof.

Another object is to provide a structure in which two alloys are joined without a significant oxide layer therebetween.

Still another object is to provide a method for forming a preform of a disk having two different metals disposed therein.

Another object is to provide a disk structure in which two different alloys are present in the inner and outer portions thereof.

Other objects will be in part apparent and in part pointed out in the description which follows.

In one of its broader aspects object of the invention can be achieved by providing a spray form apparatus in which a first metal is flowed as a stream from a first crucible to an atomization zone. The first metal is atomized in said zone and is spray deposited onto a rotating mandrel to form a first layer of a preform on the mandrel. The spray of said first metal to form a preform on said mandrel is continued. When the last portions of the first metal are present in the dispensing crucible a small portion of a second metal from a second crucible is poured into the first crucible to mix the first and second metals therein. The spray deposit is continued to spray deposit the mixed metals from the first crucible onto the preform and to continue to enlarge the preform diameter. More metal from the second crucible is continuously poured into the first crucible. The result is the substantial elimination of the first metal from the first crucible and the build up of the volume of the second metal in the fist crucible. This, in turn, results in the formation of a preform on the mandrel which has the first metal disposed directly on the mandrel and on the inner portions of the preform and which has the second metal bonded to the first metal and forming the outer portions of the preform.

BRIEF DESCRIPTION OF THE DRAWINGS

The description which follows will be understood with greater clarity if reference is made to the accompanying drawings in which.

DETAILED DESCRIPTION OF THE INVENTION

It is known that a microstructural bond is often difficult to obtain when applying a second composition onto a substrate due to the presence of an oxide layer, absence of cleanliness, or inability to obtain optimum temperature control of the part to be coated.

Oxide layers form very quickly particularly on metal which is processed at high temperature and can interfere with the formation of a desirable bond between a substrate, or layer formed on a substrate, and a subsequently applied layer of a metal.

I have found that it is possible to overcome this deficiency of prior practice by a technique which I have developed and which is illustrated in the accompanying figures in schematic form.

Figure 1:
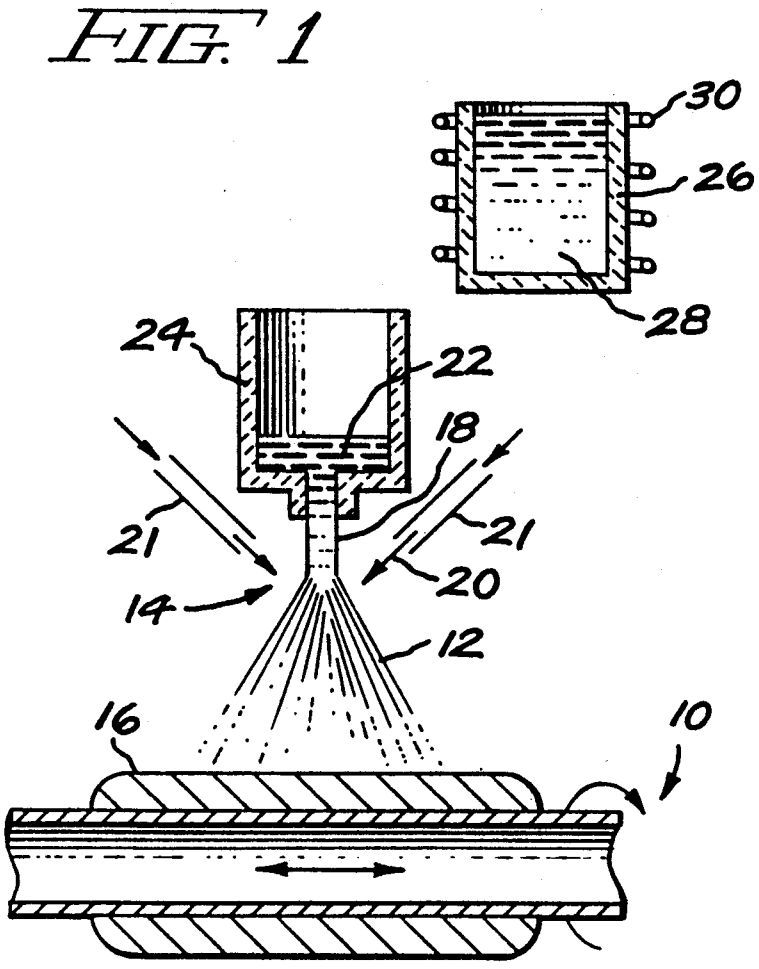
FIG. 1 is a schematic illustration of the arrangement of a mandrel, preform, atomization crucible and a second crucible.

Referring now to FIG. 1, a mandrel 10 is provided and is mounted by means not shown within an enclosure in which it can be protected by an inert atmosphere. The mandrel is mounted for rotary and reciprocating axial motion so that a spray 12 emanating from a atomization zone 14 can form a deposit 16 on an extent of the mandrel surface. The deposit 16 is in the form of a preform. A preform is a body of material of suitable character and shape to permit its later formation into an article such as a disk or other article having a desired form for an appropriate end use as for example within an aircraft engine.

The downward moving stream 18 of molten metal emanates from a body 22 of liquid metal within a dispensing or first crucible 24. Stream 18 flows down to an atomization zone 14.

In the atomization zone 14, a stream 18 of molten metal is atomized by streams of gas 20 emanating from nozzles 21 and directed into the atomization zone. The gas sources are not shown but are conventional inert spray forming gas such as argon. The inert gas used in the atomization protects the atomized droplets and the sprayed deposit from oxidation in a manner conventional to the spray forming process.

The spray atomization of a liquid metal, and the interception of the droplets formed by the atomization onto a solid surface to form a deposit, is a well known practice and is known generally in the art as the spray forming of the deposit. In this illustrative case the deposit is made in the form of a layer 16 on a mandrel and the dimensions including the width, length, thickness and etc. of the layer is such that the preform can be later mechanically acted on to give it a desired shape such as the center or inner part of a disk useful in a jet engine structure.

A second crucible 26 containing a second molten metal 28, which metal is kept in a molten state by an induction coil 30 surrounding the crucible, is disposed proximate the first crucible 24 to permit the pouring of the liquid metal 28 into the first crucible 24. However, in FIG. 1, as is evident from the schematic illustration, the second metal 28 is retained within the crucible 26 while the supply of the first liquid metal 22 is diminished to a relatively small volume.

Figure 2:
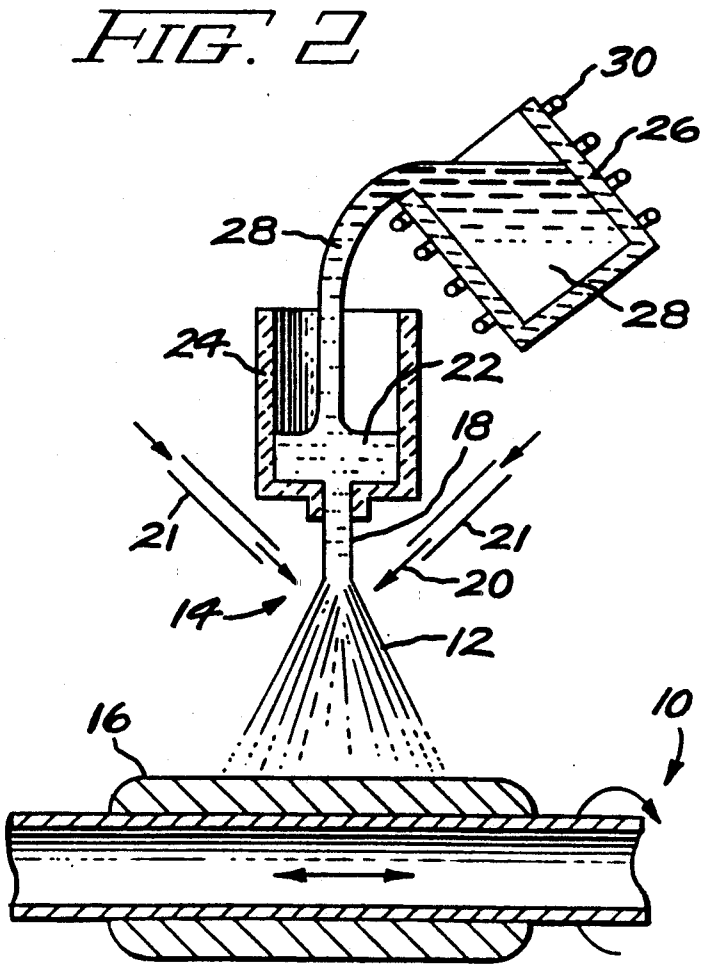
FIG. 2 is a schematic illustration similar to that of FIG. 1 but illustrating the pouring of metal from the second crucible into the first crucible.

In FIG. 2, the elements of the apparatus shown in the schematic illustration correspond to those of FIG. 1 and they bear essentially the same numbers.

What is illustrated in FIG. 2 is the start of the pouring of the content of the second crucible 26 into the first crucible 24 to continue the atomization and spray forming of the preform 16 on the mandrel 10 but employing a mixture of the first metal 22 already in the first crucible and the second metal 28 entering the first crucible 24 as a stream 32 from the top of the second crucible 26.

Figure 3:
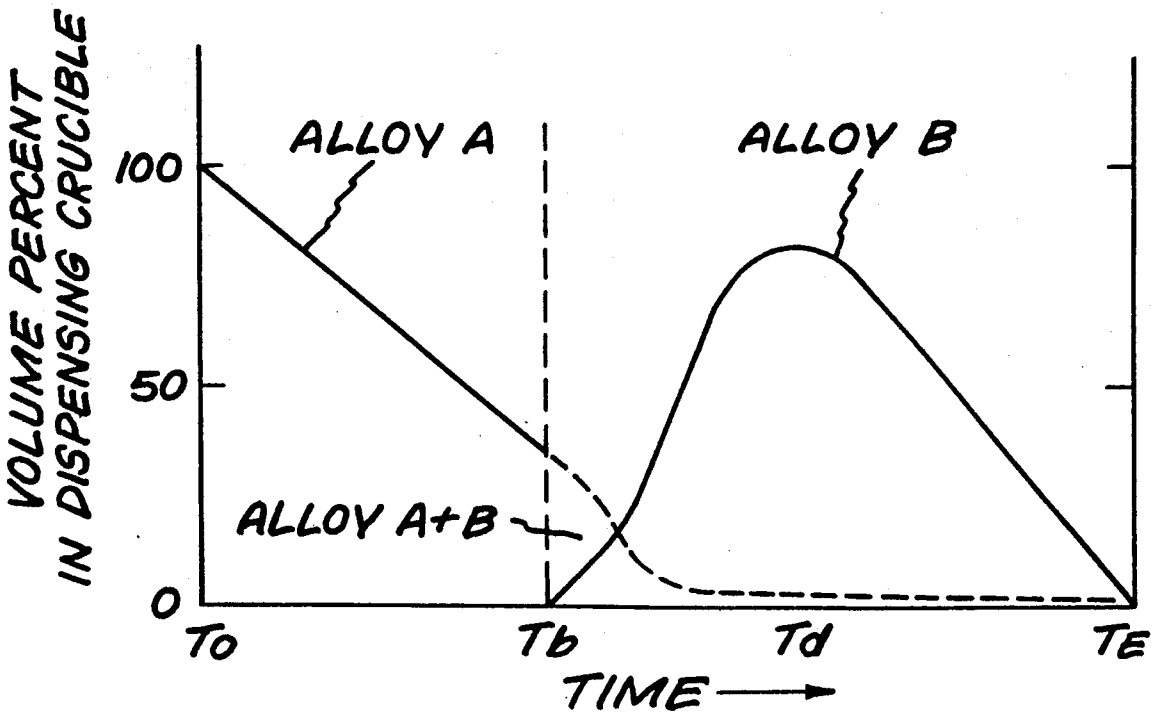
FIG. 3 is an illustration in which the volume percent of the first metal and the volume percent of the second metal present in the first crucible is plotted against time as an ordinate.

The result of the pouring and of the continuous atomization which occurs is illustrated in the FIG. 3 to which attention is now directed. In FIG. 3 the volume percent of the alloy illustratively marked as alloy A for the first alloy and alloy B for the second alloy is shown in graphical form. At time $T_o$ the volume percent of alloy A in the first or dispensing crucible is 100%. The volume percent of the alloy drops as time passes until a point $T_b$ is reached marked by a vertical dashed line. At this point, the concentration of the alloy in the dispensing crucible is still 100% alloy A while the volume percent of the alloy in the crucible has dropped to well below 50%. At this point the addition of alloy B is started from the second or reserve crucible 26 to the dispensing crucible 24. Thus the vertical dashed line is the point in time, $T_b$, at which the pouring of the alloy B from the second crucible 26 is commenced. The result is that there is a dilution of alloy A by an amount of alloy B so that the alloy flowing from the dispensing crucible is a combination of alloys A and B. Minimal dilution of alloy A with alloy B is achieved when the pouring of alloy B into the atomizing crucible is timed so that the metal stream is uninterrupted and yet the volume of alloy A is small when pouring of alloy B commences. This concentration of alloy B in the dispensing crucible increases until a maximum is reached at time $T_d$ and pouring from crucible 26 is complete. At time $T_d$ the atomizing crucible contains the most alloy B although it is very slightly diluted with alloy A, as illustrated by the dashed line showing the concentration of alloy A after the time $T_b$. This line is dashed as it varies with the precise volume of alloy A remaining in the dispensing crucible when the addition of alloy B commences.

Alloy B is then atomized to form the predominant outer composition of the part being formed. The process continues to time $T_e$ when the atomizing crucible is depleted of metal.

One problem which arises with respect to the practice of the subject method is that a desired object of the method is to provide a preform which has predominantly one metal, in the illustrative case metal A, forming the inside portion of the preform and a second metal, in the illustrative case metal B, predominantly forming the outside portion of the preform. Depending on the manner of pouring and the particular characteristics of the equipment which is being used, it may be necessary to include some successive pouring steps in the process to ensure that the first metal, A, is depleted from the dispensing crucible before the bulk of the second metal, B, is added to me dispensing crucible. For this purpose, it may be desirable to make a number of small volume additions of alloy B to the dispensing crucible as the volume percent of alloy A in the crucible is quite low. Such small additions can have the effect of aiding in the draining of the last remnants of alloy A from the dispensing crucible before the major addition of alloy B is made to the dispensing crucible. Also, such additions can have the effect of and assuring that the boundary between the inner and outer portions of the preform are formed of a blend of the two alloys, A and B, and accordingly that there is one continuous spray deposit of alloy onto the mandrel without interruption and without the possibility of formation of an undesirable oxide layer.

The criteria for selection of specific alloys for use in combinations which enhance the properties of a product, such as a disk, formed from the alloys are two fold. A first set of criteria concern the properties sought in the first portion of the product and the second set of criteria concern the properties sought in the second portion of the product.

In the case of a disk the first portion of the product is the inner or core portion. For this portion what is needed is a high strength in the alloy. An alloy such as René 95 which is a commercially available alloy, the composition of which appears in standard handbooks such as the Metals Handbook published by the American Society for Metals, has a suitably high strength and other desirable properties for use in the core of a disk.

Similarly for the outer portion of the disk what is needed is an alloy which has a low fatigue crack propagation rate. Two alloys which have such low fatigue crack propagation rates are Astroloy and Waspalloy. Both of these alloys are commercially available alloys the compositions of which are also given in standard reference texts such as the Metals Handbook referred to above. Similarly information on the relative crack propagation rates of these alloys in comparison to René 95 is given in FIG. 1 of U.S. Pat. No. 4,867,812.

Where a combination of two such alloys, that is a combination of René 95 with Waspalloy or a combination of René 95 with Astroloy, are employed the overall properties of the disk formed from such combination are deemed to be superior to a disk which is made entirely from only one such metal. Other combinations of such metals may also be employed. In addition, the article formed from a combination of two such alloys employing the method of the present invention need not be confined to only disk shaped articles but other larger articles may be fabricated by the present method, particularly where the article is large enough to encounter different temperatures or different property requirements in different portions thereof.

What is claimed is:

1. A method of forming a concentric metal structure of at least two different metals which comprises:

providing a spray forming apparatus in which a stream of molten metal is flowed from a dispensing crucible to an atomization zone;

flowing an atomizing gas into said zone to atomize said stream of molten metal;

depositing the atomized metal spray from said zone as a layer on a rotating mandrel;

providing a second crucible containing a second molten metal, pouring the metal from said second crucible into said dispensing crucible as the last portion of the said first metal is present in said dispensing crucible; and continuing the pouring of the second metal into said dispensing crucible as the spray deposit of metal from said dispensing crucible is continued to form an outer layer of said second metal on said preform.

2. The method of claim 1, in which the first metal is a high strength nickel base superalloy.

3. The method of claim 1, in which the first metal is a nickel base superalloy and the second metal is a nickel base superalloy having a low crack propagation rate.

4. The method of claim 1, in which the first metal is a high strength nickel base superalloy and the second metal is a nickel base superalloy having a low crack propagation rate.

* * * * *